US012258052B2

(12) United States Patent
Shoup et al.

(10) Patent No.: US 12,258,052 B2
(45) Date of Patent: Mar. 25, 2025

(54) UNIVERSAL BACKING RING

(71) Applicant: A. Stucki Company, Moon Township, PA (US)

(72) Inventors: Joseph Michael Shoup, Imperial, PA (US); Ryan Douglas Abel, Moon Township, PA (US); Mark John Hiszem, Tallmadge, OH (US)

(73) Assignee: A. Stucki Company, Moon Township, PA (US)

( * ) Notice: Subject to any disclaimer, the term of this patent is extended or adjusted under 35 U.S.C. 154(b) by 845 days.

(21) Appl. No.: 17/358,214

(22) Filed: Jun. 25, 2021

(65) Prior Publication Data

US 2022/0410947 A1 Dec. 29, 2022

(51) Int. Cl.
*B61F 15/22* (2006.01)

(52) U.S. Cl.
CPC ..... *B61F 15/22* (2013.01)

(58) Field of Classification Search
CPC ..... B61F 15/22; B61F 15/26
See application file for complete search history.

(56) References Cited

U.S. PATENT DOCUMENTS

| | | | | |
|---|---|---|---|---|
| 757,466 | A | 4/1904 | Jacquemin | |
| 7,219,938 | B2 | 5/2007 | Brister et al. | |
| 7,534,047 | B2 | 5/2009 | Reed | |
| 8,226,299 | B2 * | 7/2012 | Hubbard | F16C 35/063 384/585 |
| 8,696,212 | B2 * | 4/2014 | Hubbard | F16C 35/063 384/489 |
| 9,016,950 | B2 | 4/2015 | Buchanan et al. | |
| 9,789,887 | B2 | 10/2017 | Johansson et al. | |
| 10,330,156 | B2 * | 6/2019 | Hubbard | F16C 33/7886 |
| 10,625,757 | B2 * | 4/2020 | Conway, Jr. | B61F 15/22 |
| 2012/0195540 | A1 * | 8/2012 | Hubbard | B61F 15/22 384/572 |
| 2020/0207382 | A1 | 7/2020 | Conway | |

FOREIGN PATENT DOCUMENTS

WO 2019203992 A1 10/2019

OTHER PUBLICATIONS

International Search Report for PCT/US2022/35104 dated Oct. 5, 2022.
Written Opinion of the International Searching Authority for PCT/US2022/35104 dated Oct. 5, 2022.

* cited by examiner

*Primary Examiner* — Jason R Bellinger
(74) *Attorney, Agent, or Firm* — Buchanan Ingersoll & Rooney PC

(57) ABSTRACT

Disclosed is a one-piece, integrally formed universal backing ring having an integrally formed, one piece annular structure with a center opening configured to be translated over a journal of a railcar axle and engage a dust guard and a dust guard fillet of the railcar axle. The annular structure includes an inner contoured surface having a profile that is contoured for a tight surface fit with a complementary surface of the dust guard fillet. The annular structure also includes a dust guard lip which projects over the dust guard fillet and engages the dust guard. The dust guard lip has a length extending generally parallel with an axis of the annular structure, and is configured to provide a mechanical interference fit of the dust guard lip with the dust guard of 0.052-0.1875 inches with a maximum diameter of the dust guard for each Class of railcar axle.

19 Claims, 6 Drawing Sheets

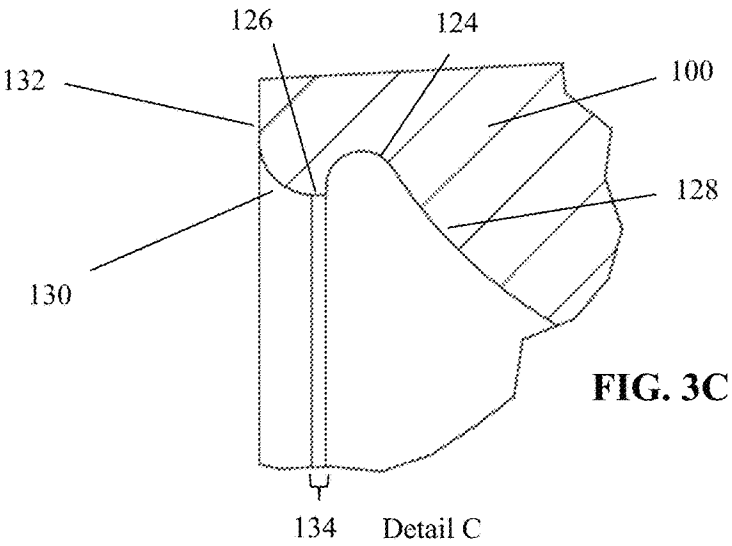
FIG. 3C
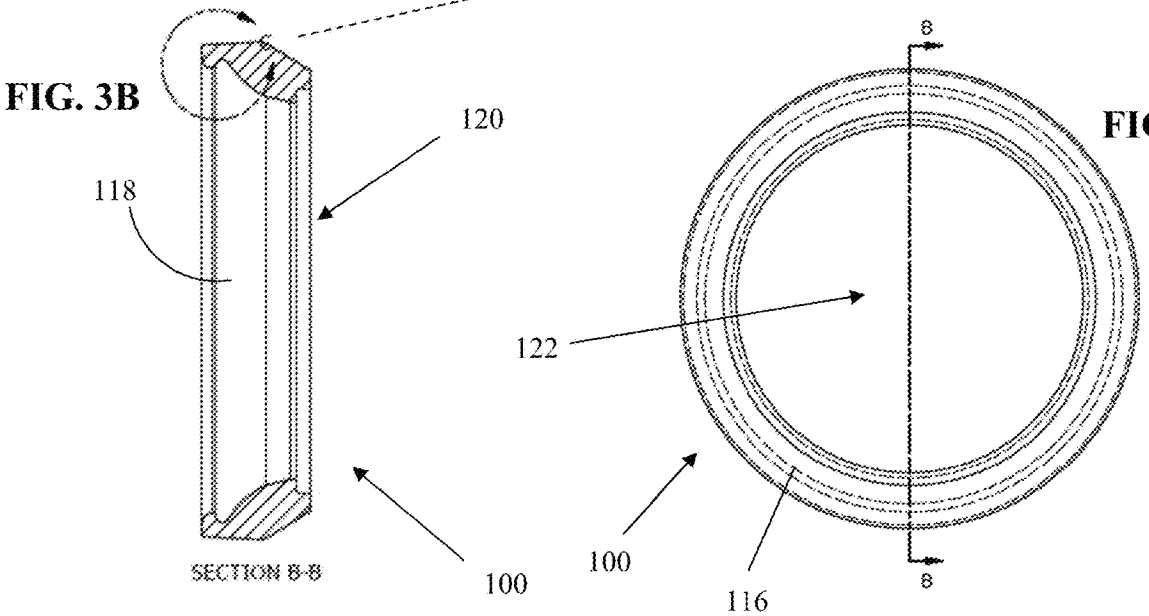
FIG. 3A
FIG. 3B

H
H
116
100
122

100
128
126
130
Detail I
120
I
118
100
SECTION H-H

UNIVERSAL BACKING RING

FIELD OF THE INVENTION

Embodiments relate to a one-piece, integrally formed universal backing ring having an annular structure with an inner surface and an outer surface. The inner surface has a profile that allows it to form a mechanical interference fit with a dust guard of a railcar axle.

BACKGROUND OF THE INVENTION

Railcar axles are generally elongated cylindrical structures having a stepped-out feature (e.g., stepped-out in diameter) near each distal end. Each stepped-out feature leads to a journal portion, which is a stepped-down feature, and then to a distal end of the axle. The stepped-out feature includes structural formations, such as a dust guard and a dust guard fillet. A bearing is placed over the journal to support a wheel and facilitate free rotational motion of the wheel. Between the bearing and stepped-out feature is placed a backing ring. Known universal backing rings are limited in that they consist of two-piece structures—e.g., a backing ring portion and a stabilizing ring portion. The two-piece arrangement allows for a proper and snug fit between the known universal backing ring and the stepped-out portion, and in particular between the known universal backing ring and the dust guard and dust guard fillet features of the stepped-out portion. Of course, this requires the manufacture and construction of two separate pieces for each backing ring, which leads to increased manufacturing, production and assembly costs.

Fitted backing rings exist; however, each fitted backing ring is designed to fit a railcar axle having a specific diameter. In order for the fitted backing ring to fit properly, the railcar axle diameter must have a very small tolerance. Fitted backing rings are used with new railcar axles, as those will have the specific diameter to which the fitted backing ring is designed. Once the railcar axle wears, fitted backing rings cannot be used, as the railcar axle diameter will wear to a diameter quickly outside of the very small tolerance.

Universal backing rings exist that are configured for use with railcar axles having a greater diameter range than that for fitted backing rings. Universal backing rings are typically utilized in connection with used railcar axles. However, universal backing rings include a two-piece construction having a rigid, ring portion and a sealing, stabilizing or compression element positioned around the inner circumference of the ring portion. The sealing, stabilizing or compression element engages the dust guard of the railcar axle to provide the seal. However, the two-piece construction leads to increased manufacturing, production and assembly costs.

Conventional backing ring devices can be appreciated from at least at U.S. Pat. Nos. 7,219,938; 7,534,047; 8,226,299; 8,696,212; 9,016,950; and 9,789,887, and U.S. Publication No. 2020/0207382.

Embodiments disclosed herein are directed toward overcoming one or more of the above-identified disadvantages discussed above, although not necessarily limited to embodiments that do.

SUMMARY OF THE INVENTION

Embodiments relate to a one-piece, integrally formed universal backing ring having an annular structure with an inner surface and an outer surface. The inner surface has a profile that allows it to form a mechanical interference fit with a dust guard of a railcar axle. The annular structure is made from material exhibiting a predetermined stiffness allowing portions of the annular structure to deflect, facilitating the mechanical interference fit with the dust guard.

In one embodiment, a one-piece, integrally formed universal backing ring includes an integrally formed, one piece annular structure having a center opening configured to be translated over a journal of a railcar axle and engage a dust guard and a dust guard fillet of the railcar axle. The annular structure includes an inner contoured surface having a profile that is contoured for a tight surface fit with a complementary surface of the dust guard fillet. The annular structure includes a dust guard lip which projects over the dust guard fillet and engages the dust guard via a mechanical interference fit, the dust guard lip generally parallel with an axis of the annular structure and having a length of 0.000-0.375 inches. The annular structure includes a relief groove disposed between the inner contoured surface and the dust guard lip. The relief groove has a radius of curvature and a radial depth of 0.040-0.438 inches from the dust guard lip.

In some embodiments, the annular structure has a radially contoured edge portion extending from the dust guard lip with a radius of curvature toward an outer surface of the annular structure and terminating at an edge of the annular structure.

In some embodiments, the annular structure is made of material exhibiting a predetermined stiffness allowing portions of the annular structure at the relief groove, the radially contoured edge portion and the dust guard lip to deflect, facilitating the mechanical interference fit of the dust guard lip with the dust guard.

In some embodiments, the radially contoured edge portion has a radius of 0.030-0.375 inches.

In some embodiments, the radially contoured edge portion is convex.

In some embodiments, the relief groove has a radius of 0.030-0.438 inches.

In some embodiments, the relief groove is concave.

In some embodiments, the integrally formed, one piece annular structure is made from ductile iron, steel, or a combination of both.

In another embodiment, a one-piece, integrally formed universal backing ring includes an integrally formed, one piece annular structure having a center opening configured to be translated over a journal of a railcar axle and engage a dust guard and a dust guard fillet of the railcar axle. The annular structure includes an inner contoured surface having a profile that is contoured for a tight surface fit with a complementary surface of the dust guard fillet. The annular structure includes a dust guard lip which projects over the dust guard fillet and engages the dust guard. The dust guard lip has a length extending generally parallel with an axis of the annular structure. The dust guard lip is configured to provide a mechanical interference fit of the dust guard lip with the dust guard of 0.052-0.1875 inches with a maximum diameter of the dust guard for each Class of railcar axle.

In some embodiments, the annular structure has a relief groove disposed between the inner contoured surface and the dust guard lip. The relief groove has a radius of curvature and a radial depth extending radially from the dust guard lip.

In some embodiments, the relief groove has a radial depth of 0.040-0.438 inches from the dust guard lip.

In some embodiments, the relief groove has a radius of 0.030-0.438 inches.

In some embodiments, the relief groove is concave.

In some embodiments, the annular structure includes a radially contoured edge portion extending from the dust guard lip with a radius of curvature toward an outer surface of the annular structure and terminating at an edge of the annular structure.

In some embodiments, the annular structure is made of material exhibiting a predetermined stiffness allowing portions of the annular structure at the relief groove, the radially contoured edge portion and the dust guard lip to deflect, facilitating the mechanical interference fit of the dust guard lip with the dust guard.

In some embodiments, the radially contoured edge portion has a radius of 0.030-0.375 inches.

In some embodiments, the radially contoured edge portion is convex.

In some embodiments, dust guard lip has a length of 0.000-0.375 inches.

Railcar axles are typically rated by Class. At the time of filing this application, the current railcar Class ratings by the American Association of Railroads (AAR) are: Axle Class E; Axle Class F; Axle Class K; and Axle Class G.

At the time of filing this application, the current AAR maximum dust guard diameter for a universal backing ring for each Class of railcar axle is: 7.032 inches for an Axle Class E; 7.532 inches for an Axle Class F; 7.532 inches for an Axle Class K; and 8.002 inches for an Axle Class G. This is referred to herein as the "maximum diameter of the dust guard for each Class of railcar axle".

At the time of filing this application, the current AAR minimum dust guard diameter for a universal backing ring for each Class of railcar axle is: 6.980 inches for an Axle Class E; 7.480 inches for an Axle Class F; 7.480 inches for an Axle Class K; and 7.950 inches for an Axle Class G. This is referred to herein as the "minimum diameter of the dust guard for each Class of railcar axle".

In some embodiments, the integrally formed, one piece annular structure is made from ductile iron, steel, or a combination of both.

Further features, aspects, objects, advantages, and possible applications of the present invention will become apparent from a study of the exemplary embodiments and examples described below, in combination with the Figures, and the appended claims.

BRIEF DESCRIPTION OF THE DRAWINGS

At least the above and other objects, aspects, features, advantages and possible applications of the present innovation will be more apparent from the following more particular description thereof, presented in conjunction with the following drawings. Like reference numbers used in the drawings may identify like components.

FIG. 2A is a side view of a railcar axle with an embodiment of the universal backing ring attached to one end of the axle. FIG. 2B is an end view of a railcar axle. FIG. 2C is a cross-sectional taken along line A-A in FIG. 2B.

FIGS. 3A-3C show end, cross-sectional and exploded cross-sectional views of an embodiment of the universal backing ring. FIG. 3A is an end view of the inventive universal backing ring having a relief groove. FIG. 3B is a cross-sectional view taken along line B-B in FIG. 3A. FIG. 3C is an exploded cross-sectional view illustrating portion C in FIG. 3B.

FIG. 4A is an end view of the inventive universal backing ring without a relief groove. FIG. 4B is a cross-sectional view taken along line H-H in FIG. 4A. FIG. 4C is an exploded cross-sectional view illustrating portion I in FIG. 4B.

FIG. 5A is a side view of a railcar axle with an embodiment of the universal backing ring and a bearing attached to one end of the axle. FIG. 5B is an end view of the railcar axle of FIG. 5A having the bearing attached thereto. FIG. 5C is a partial cross-sectional view of the axle end having the bearing taken along line D-D in FIG. 5B.

DETAILED DESCRIPTION OF THE INVENTION

Figure 1:
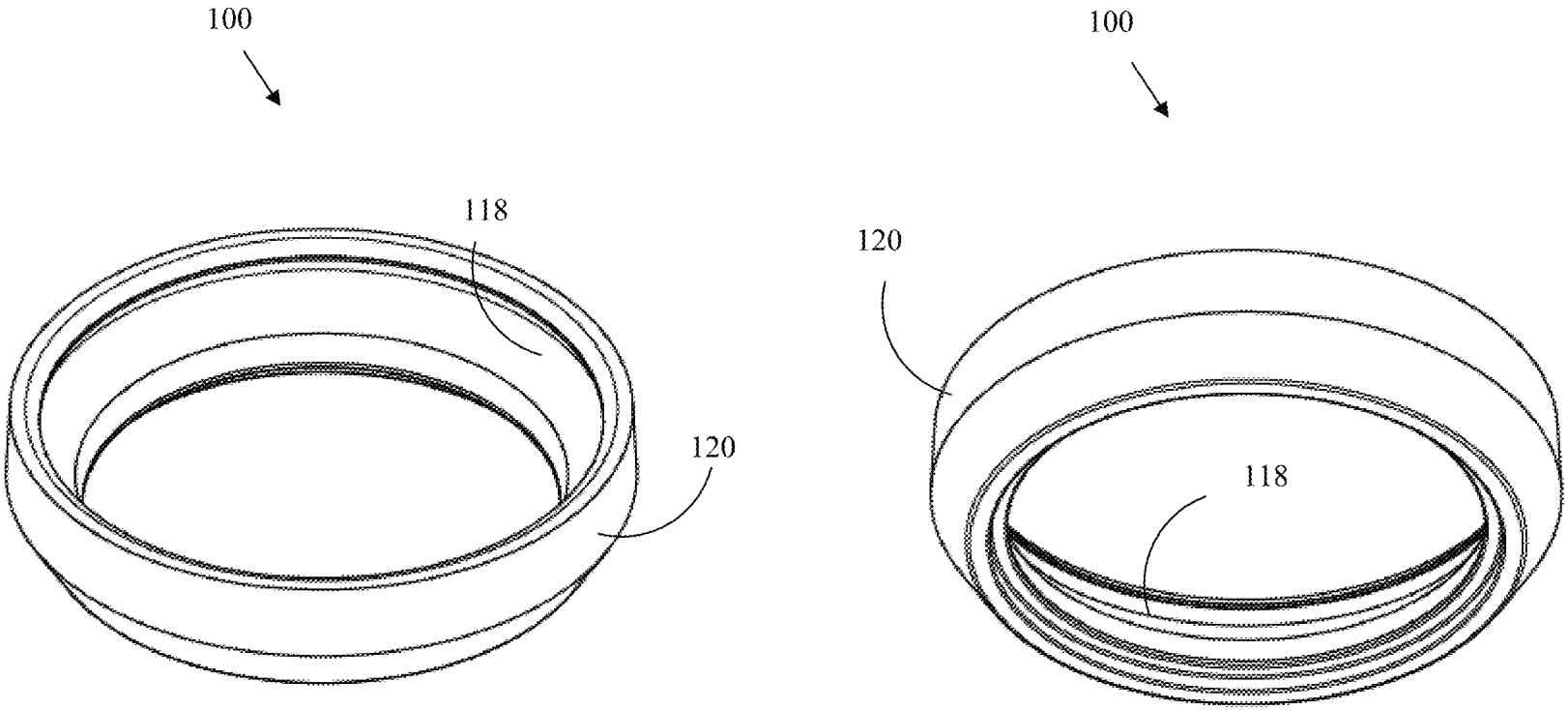
FIG. 1 shows an embodiment of the inventive universal backing ring.
Figure 2A:
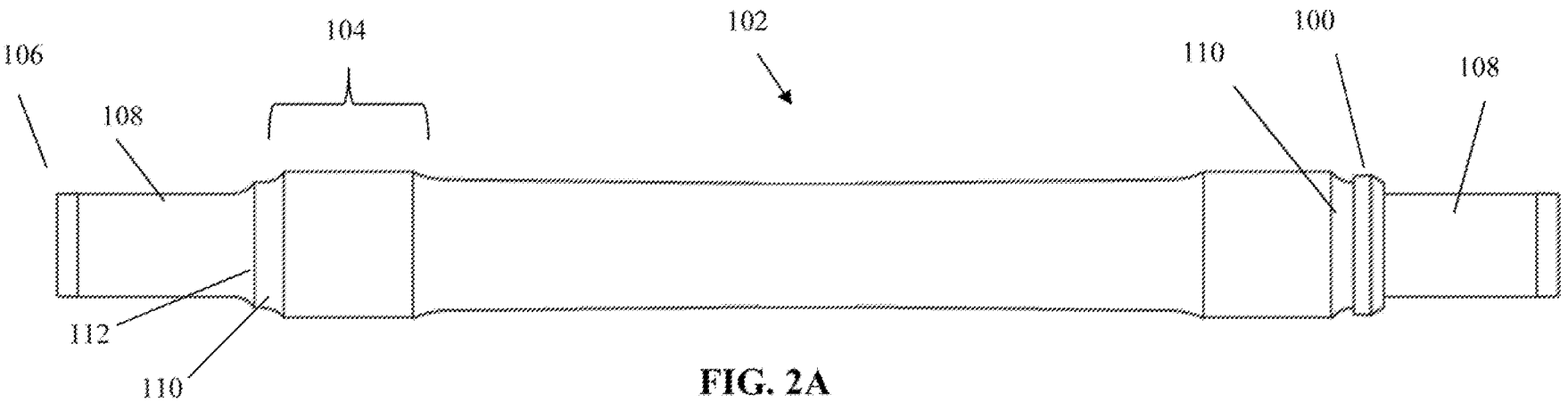
FIGS. 2A-2C show side, end and cross-sectional views of a railcar axle having an embodiment of the universal backing ring attached thereto.
Figure 2B:
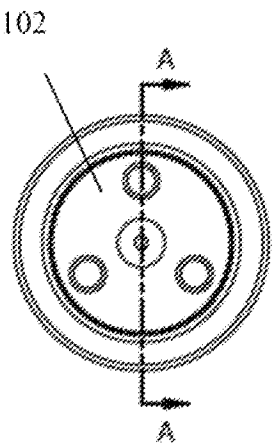
Figure 2C:
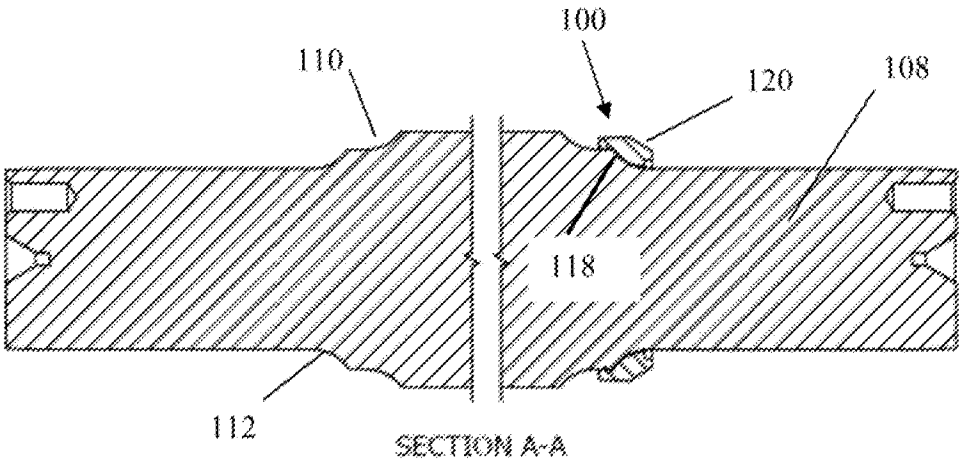

The following description is of exemplary embodiments that are presently contemplated for carrying out the present invention. This description is not to be taken in a limiting sense, but is made merely for the purpose of describing the general principles and features of various aspects of the present invention. The scope of the present invention is not limited by this description.

Referring to FIGS. 1-6, embodiments relate to a one-piece, integrally formed universal backing ring 100 for a railcar axle 102. The railcar axle 102 is generally an elongated cylindrical structure having a stepped-out feature 104 (e.g., stepped-out in diameter) near each distal end 106. Each stepped-out feature 104 leads to a journal 108, which is a stepped-down feature, and then to a distal end 106 of the railcar axle 102. The stepped-out feature 104 includes structural formations, such as a dust guard 110 and dust guard fillet 112. During use of the railcar axle 102, a bearing 114 (see FIGS. 5A-5C) is placed over the journal 108 to support a wheel (not shown) and facilitate free rotational motion of the wheel. Between the bearing 114 and the stepped-out feature 104 is placed an embodiment of the universal backing ring 100.

The universal backing ring 100 includes an integrally formed, one piece annular structure 116 having a center opening 122. The ring 100 is configured to be translated over a journal 108 of a railcar axle 102 and engage a dust guard 110 and/or a dust guard fillet 112 of the railcar axle 102. The annular structure 116 has an inner surface 118 and an outer surface 120. The inner surface 118, or at least a portion thereof, is configured to slide over and form a mechanical interference fit with the dust guard 110 of the railcar axle 102. Thus, it is contemplated for the inner surface 118 of the annular structure 116 to have diameters that match, or closely match, the diameters of the journal 108 and the stepped-out feature 104 of the railcar axle 102 (i.e., the dust guard 110 and the dust guard fillet 112). It is contemplated for the annular structure 116 to be made from ductile iron, steel, or a combination thereof; however, it can be made from other metals or metal alloys.

The annular structure 116 has an inner contoured surface 128 having a profile that is contoured for a tight surface fit with a complementary surface of the dust guard fillet 112. The annular structure 116 also includes a dust guard lip 126 which engages, via a mechanical interference fit, the dust guard 110 of the railcar axle 102. Upon engagement of the dust guard lip 126 with the dust guard 110, the inner contoured surface 128 forms a tight surface fit with the dust guard fillet 112. It is contemplated for the dust guard lip 126 to extend generally parallel with an axis of the annular structure 116 and have a length (designated at 134 in FIG. 3C). The length can range from 0.000 inches (see FIGS. 6A-6C) to 0.375 inches.

As shown more clearly in FIGS. 3 and 6, in some embodiments, the inner surface 118 of the annular structure 116 has a relief groove 124. The relief groove 124 is disposed between the inner contoured surface 128 and the dust guard lip 126. The relief groove 124 is a recessed portion of specified form and dimensions created by removing material from the inner surface 118 so that the relief groove 124 has a radial depth extending radially from the dust guard lip 126 and, therefore, has a diameter greater than that of the dust guard lip 126. It is contemplated for the relief groove 124 to be formed about an entire inner surface 118 circumference of the annular structure 116. The relief groove 124 can be configured such that, when the universal backing ring 100 is translated over the journal 108 and forced to engage with the stepped-out feature 104, the relief groove 124 aids in facilitating deflection of the dust guard lip 126 to facilitate the mechanical interference fit of the dust guard lip 126 with the dust guard 110 on the railcar axle 102. The relief groove 124 also helps facilitate a tight surface fit of the inner contoured surface 128 with the dust guard fillet 112 of the railcar axle 102.

The relief groove 124 can have a profile that is curved, angled, square, triangular, etc. However, it is contemplated for the relief groove 124 to be semi-circular and, therefore, have a radius of curvature. The relief groove 124 can have a radial depth of 0.040-0.438 inches, for example, from the dust guard lip 126. The relief groove 124, or a portion thereof, can also, or alternatively, have a radius of 0.030-0.438 inches.

Figures 4A, 4B, 4C:
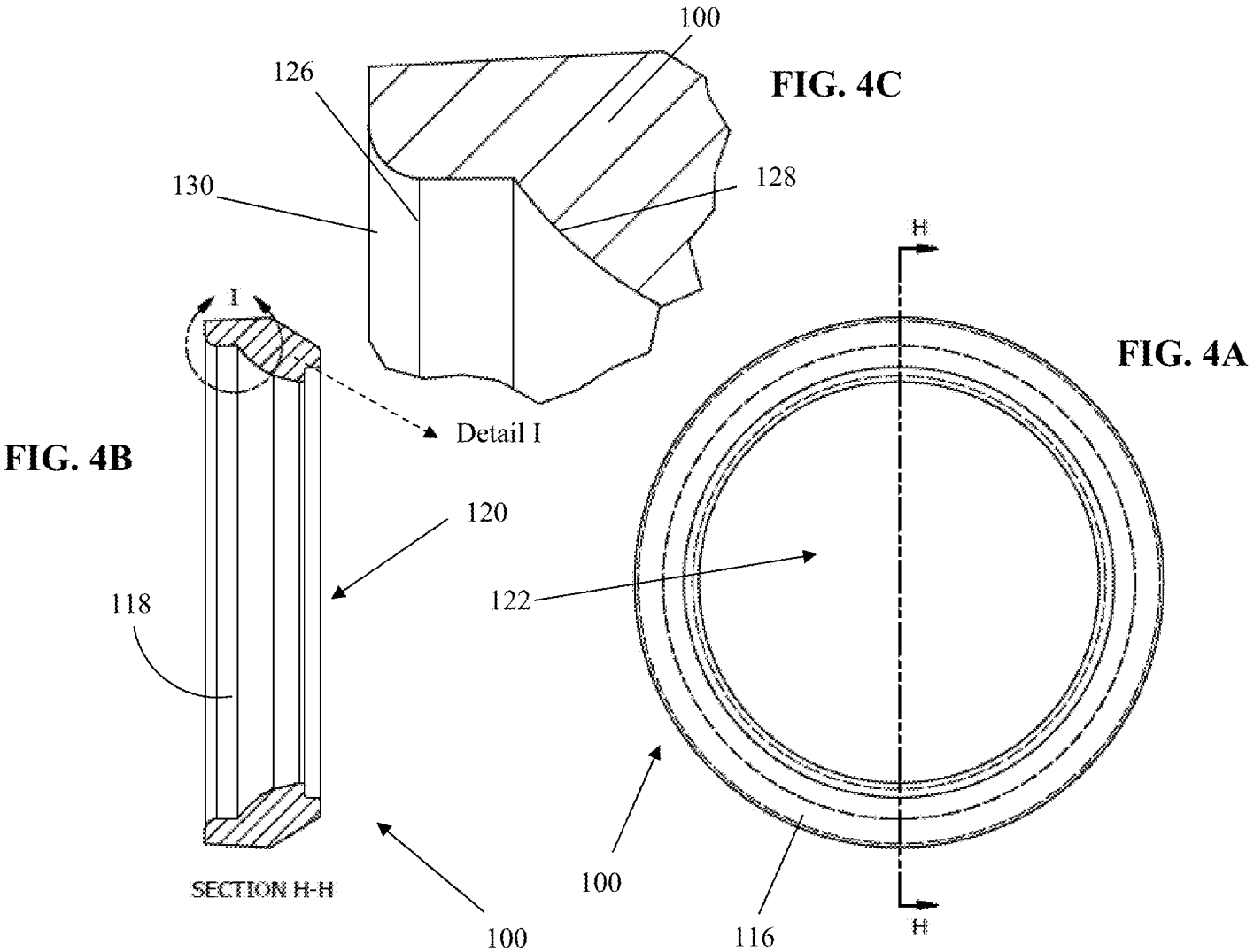
FIGS. 4A-4C show end, cross-sectional and exploded cross-sectional views of an embodiment of the universal backing ring.
Figure 5A:
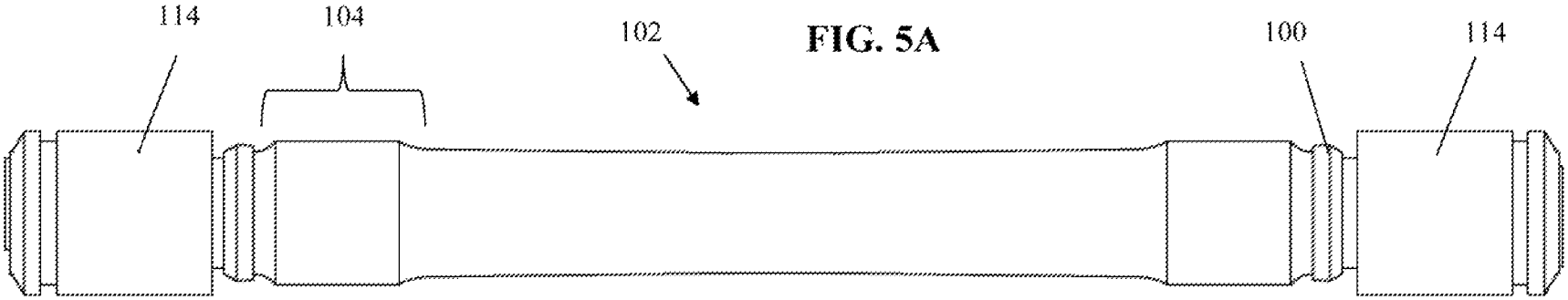
FIGS. 5A-5C show side, end and partial cross-sectional views of a railcar axle having an embodiment of the universal backing ring and a bearing attached thereto.
Figure 5B:
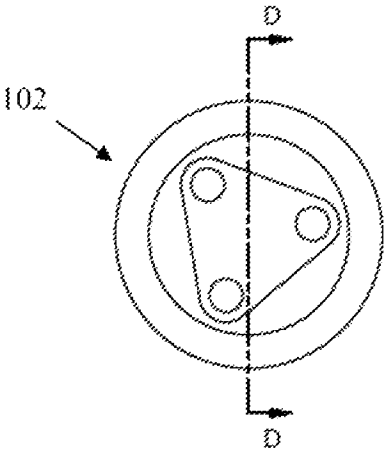
Figure 5C:
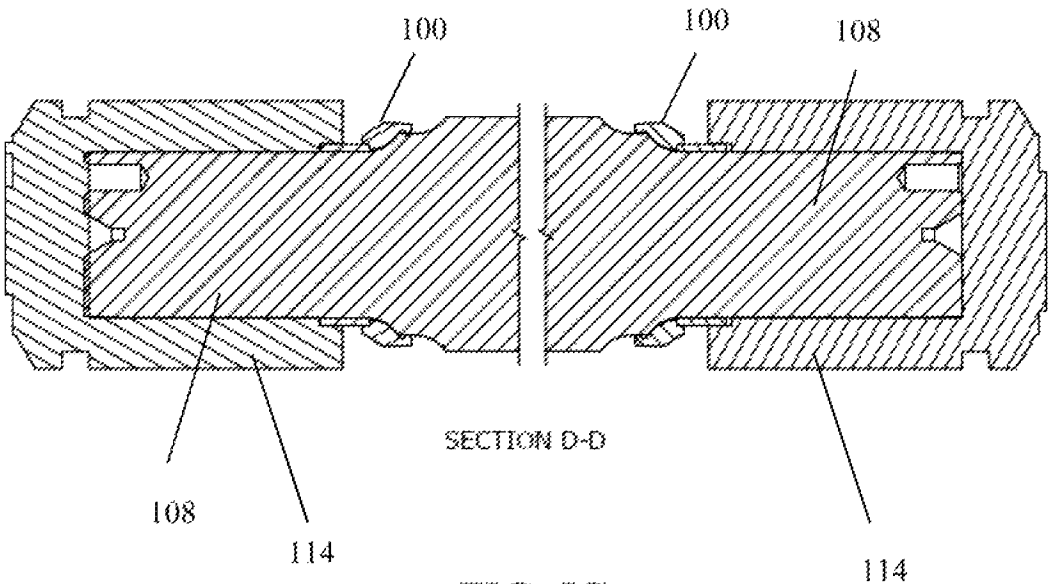

Referring to FIGS. 4A-4C, in some embodiments, the relief groove 124 can be omitted while still providing the necessary mechanical interference fit between the dust guard lip 126 and the dust guard 110. For example, as shown in FIG. 4C, the dust guard lip 126 can extend to the inner contoured surface 128, thus omitting the relief groove 124 from the universal backing ring 100.

As noted herein, the inner surface 118 of the annular structure 116 includes a dust guard lip 126. It is contemplated for the dust guard lip 126 to be formed about an entire inner surface 118 circumference of the annular structure 116. When the universal backing ring 100 is translated over the journal 108 and engages with the stepped-out feature 104, the dust guard lip 126 engages with the dust guard 110 via a mechanical interference fit to provide a proper and snug fit between the universal backing ring 100 and the dust guard 110.

In some embodiments, the annular structure 116 has a radially contoured edge portion 130 extending from the dust guard lip 126 with a radius of curvature toward the outer surface 120 of the annular structure 116 and terminating at an edge 132 of the annular structure 116. The radially contoured edge portion 130, or a portion thereof, can have a radius of 0.030-0.375 inches. Or course, one skilled in the art will appreciate that other radiuses and/or geometric curvatures are contemplated herein.

It is contemplated for the annular structure 116 to comprise material exhibiting a predetermined stiffness allowing portions of the annular structure 116 to deflect, facilitating the mechanical interference fit between the dust guard lip 126 and the dust guard 110. For instance, the deflection can be of the dust guard lip 126 to allow it to be slid over and engage the dust guard 110. The deflection of portions of the annular structure 116 occurs without damage or material degradation to the annular structure 116 itself. With embodiments including the relief groove 124, the relief groove 124 may better facilitate this deflection due to the reduced amount of material at that location—e.g., the deflection of the annular structure 116 at or near the relief groove 124 and the reduced amount of material at the relief groove 124 can provide for more flex as compared to an annular structure 116 without a relief groove 124.

In one embodiment, the annular structure 116 is made of material exhibiting a predetermined stiffness allowing portions of the annular structure 116 at the relief groove 124, the radially contoured edge portion 130, and the dust guard lip 126 to deflect, facilitating the mechanical interference fit of the dust guard lip 126 with the dust guard 110.

Some embodiments include a relief groove 124 disposed between the inner contoured surface 128 and the dust guard lip 126. The relief groove 124 has a radius of curvature and a radial depth extending radially from the dust guard lip 126. The relief groove 124 is concave, has a radial depth of 0.040-0.438 inches from the dust guard lip 126, and a radius of 0.030-0.438 inches. The annular structure 116 also has a radially contoured edge portion 130 extending from the dust guard lip 126 with a radius of curvature toward an outer surface of the annular structure 116 and terminating at an edge 132 of the annular structure 116. The annular structure 116 is made of material exhibiting a predetermined stiffness allowing portions of the annular structure 116 at the relief groove 124, the radially contoured edge portion 130, and the dust guard lip 126 to deflect, facilitating the mechanical interference fit with the dust guard 110. The radially contoured edge portion 130 is convex and has a radius of 0.030-0.375 inches. The dust guard lip 126 has a length 134 of 0.000-0.375 inches.

Figure 6A:
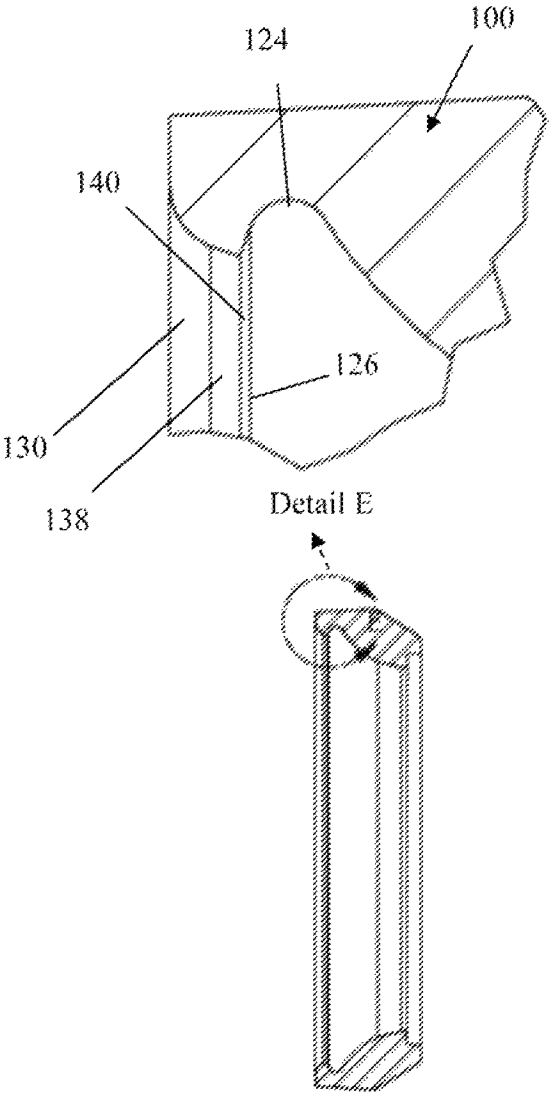
FIGS. 6A-6C show cross-sectional and exploded cross-sectional views of embodiments of the universal backing ring in which the dust guard lip has zero length.
Figure 6C:
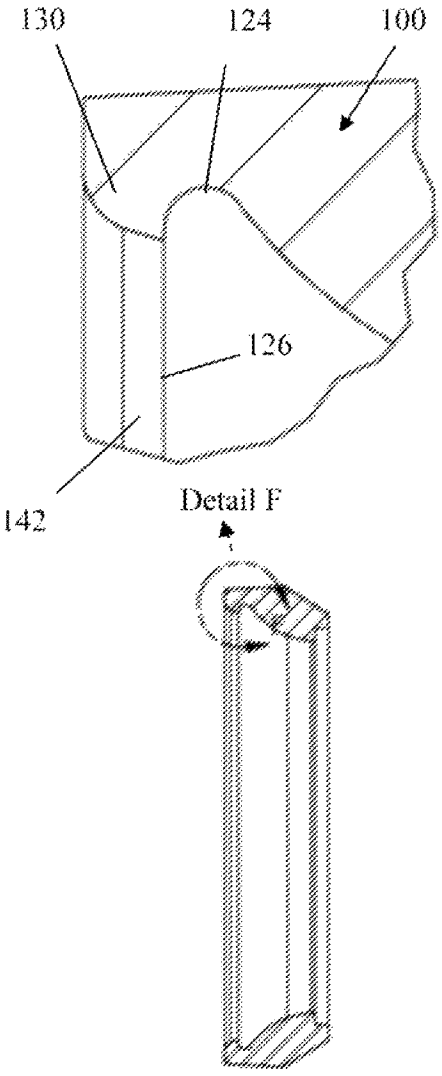
Figure 6B:
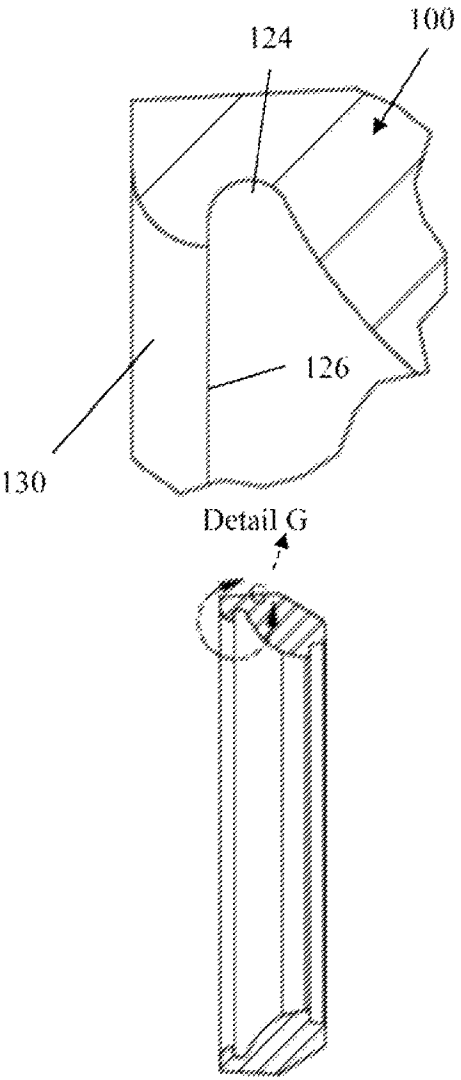

FIGS. 6A-6C illustrate the dust guard lip 126 having a length of 0.000 inches. As shown in FIG. 6A, the radially contoured edge portion 130 includes a straight portion 138 that terminates at the dust guard lip 126. Similarly, the relief groove 124 also includes a straight angled portion 140 that terminates at the dust guard lip 126. The two straight portions 138 and 140 meet and form the dust guard lip 126 having a length of essentially 0.000 inches. As shown in FIG. 6B, the radially contoured edge portion 130 terminates at the dust guard lip 126 along with the edge of the relief groove 124. These portions meet and form the dust guard lip 126 having a length of essentially 0.000 inches. As shown in FIG. 6C, the radially contoured edge portion 130 includes a straight portion 142 that terminates at the dust guard lip 126. The edge of the relief groove 124 also terminates at the dust guard lip, thus meeting the straight portion 140 and form the dust guard lip 126 having a length of essentially 0.000 inches. While exemplary configurations are illustrated in FIGS. 6A-6C, one skilled in the art will appreciated that other geometric configurations may be implemented to facilitate a dust guard lip 126 having a length of essentially 0.000 inches without departing from the spirit and scope of the present invention.

An exemplary use of the universal backing ring 100 can be as follows. The universal backing ring 100 is forced to engage with the stepped-out feature 104 by translating it over the journal 108 until it abuts the stepped-out feature 104, such that the inner surface 118 abuts the stepped-out feature 104. Additional force is applied to the outer surface 120 (e.g., via hydraulic press or the like) to further advance the universal backing ring 100 towards the stepped-out feature 104 so that the inner surface 118 slides over, or partially slides over, the stepped-out feature 104. This causes the annular structure 116 at the relief groove 124 and/or the dust guard lip 126 to deflect until the universal backing ring 100 is advanced to a positon at which the inner contoured surface 128 and the dust guard lip 126 are aligned with the dust guard fillet 112 and the dust guard 110, respectively. The annular structure 116 at the relief groove 124 and/or the dust guard lip 126 flexes or deflects to form an interference fit with the stepped-out feature 104; specifically an interference between the dust guard lip 126 and the dust guard 110. Notably, this is achieved with a unitary, integrally formed annular structure 116, as opposed to two separate pieces (e.g., a backing ring and a stabilizing ring or some other "stabilizing" unit) used by conventional systems utilizing a "universal" type backing ring. In addition, the universal backing ring 100, with its material properties and inner surface 118 profile, facilitates use with different sized (different diameters) railcar axles 102 within a given Class. This aspect makes the universal backing ring 100 "universal".

In an exemplary embodiment, a one-piece, integrally formed universal backing ring 100 includes an integrally formed, one piece annular structure 116 having a center opening 122 configured to be translated over a journal 108 of a railcar axle 102 and engage a dust guard 110 and a dust guard fillet 112 of the railcar axle 102. The annular structure 116 includes an inner contoured surface 128 having a profile that is contoured for a tight surface fit with a complementary surface of the dust guard fillet 112. The annular structure 116 has a dust guard lip 126 which projects over the dust guard fillet 112 and engages the dust guard 110. The dust guard lip 126 has a length 134 extending generally parallel with an axis of the annular structure 116. The dust guard lip 126 is configured to provide a mechanical interference fit of the dust guard lip 126 with the dust guard 110 of 0.052-0.1875 inches with a maximum diameter of the dust guard 110 for each Class of railcar axle 102.

As noted herein, the universal backing ring 100 is "universal" in that a single universal backing ring 100 can be interchangeably used with different railcar axles 102 (e.g., used railcar axles) in a particular Class, each railcar axle 102 in the particular Class having a stepped-out feature 104 with a diameter of the dust guard 110 that differs from a diameter of the dust guard 110 of another railcar axle's 102 stepped-out feature 104. Thus, it is contemplated herein that a single universal backing ring 100 can be used with any railcar axle 102 within a particular Class that is within the minimum and maximum axle diameters for that particular Class as established by the American Association of Railroads. (AAR).

The current railcar Class ratings by the AAR are: Axle Class E; Axle Class F; Axle Class K; and Axle Class G. The minimum and maximum diameters pertain to a min/max diameter at the dust guard 110. A railcar axle 102 must have a diameter within the min/max range in order to remain in service. Table 1 below sets forth the minimum and maximum diameters of the dust guard 110 for each different railcar axle Class. The maximum value is referred to herein as the "minimum diameter of the dust guard for each Class of railcar axle". The minimum value is referred to herein as the "minimum diameter of the dust guard for each Class of railcar axle".

TABLE 1

Minimum and Maximum Diameters for Axle Classes

| Axle Class | Minimum (inches) | Maximum (inches) |
|---|---|---|
| E | 6.980 | 7.032 |
| F | 7.480 | 7.532 |
| K | 7.480 | 7.532 |
| G | 7.950 | 8.002 |

It should be understood that modifications to the embodiments disclosed herein can be made to meet a particular set of design criteria. For instance, the number of or configuration of components or parameters of the various embodiments may be interchangeably used to meet a particular objective.

It will be apparent to those skilled in the art that numerous modifications and variations of the described examples and embodiments are possible in light of the above teachings of the disclosure. The disclosed examples and embodiments are presented for purposes of illustration only. Other alternative embodiments may include some or all of the features of the various embodiments disclosed herein. Therefore, it is the intent to cover all such modifications and alternate embodiments as may come within the true scope of this invention, which is to be given the full breadth thereof. For instance, it is contemplated that a particular feature described, either individually or as part of an embodiment, can be combined with other individually described features, or parts of other embodiments. The elements and acts of the various embodiments described herein can therefore be combined to provide further embodiments. Additionally, the disclosure of a range of values is a disclosure of every numerical value within that range, including the end points.

It is the intent to cover all such modifications and alternative embodiments as may come within the true scope of this invention, which is to be given the full breadth thereof.

Additionally, the disclosure of a range of values is a disclosure of every numerical value within that range, including the end points. Thus, while certain exemplary embodiments of the device and methods of making and using the same have been discussed and illustrated herein, it is to be distinctly understood that the invention is not limited thereto but may be otherwise variously embodied and practiced within the scope of the following claims.

What is claimed is:

1. A one-piece, integrally formed universal backing ring, comprising:

an integrally formed, one piece annular structure having a center opening configured to be translated over a journal of a railcar axle and engage a dust guard and a dust guard fillet of the railcar axle, the annular structure comprising:

an inner contoured surface having a profile that is contoured for a fit with a complementary surface of the dust guard fillet;

a dust guard lip which projects over the dust guard fillet and is configured to engage the dust guard by a mechanical interference fit, the dust guard lip generally parallel with an axis of the annular structure and having a length of 0.000-0.375 inches; and a relief groove disposed between the inner contoured surface and the dust guard lip, the relief groove having a radius of curvature and having a radial depth of 0.040-0.438 inches from the dust guard lip;

wherein the annular structure further comprises a radially contoured edge portion extending from the dust guard lip with a radius of curvature toward an outer surface of the annular structure and terminating at an edge of the annular structure.

2. The one-piece, integrally formed universal backing ring of claim 1, wherein the annular structure is made of material exhibiting a predetermined stiffness allowing portions of the annular structure at the relief groove, the radially contoured edge portion and the dust guard lip to deflect, facilitating the mechanical interference fit of the dust guard lip with the dust guard.

3. The one-piece, integrally formed universal backing ring of claim 1, wherein the radially contoured edge portion has a radius of 0.030-0.375 inches.

4. The one-piece, integrally formed universal backing ring of claim 1, wherein the radially contoured edge portion is convex.

5. The one-piece, integrally formed universal backing ring of claim 1, wherein the relief groove has a radius of 0.030-0.438 inches.

6. The one-piece, integrally formed universal backing ring of claim 1, wherein the relief groove is concave.

7. The one-piece, integrally formed universal backing ring of claim 1, wherein the integrally formed, one piece annular structure comprises ductile iron or steel.

8. A one-piece, integrally formed universal backing ring, comprising:

an integrally formed, one piece annular structure having a center opening configured to be translated over a journal of a railcar axle and engage a dust guard and a dust guard fillet of the railcar axle, the annular structure comprising:

an inner contoured surface having a profile that is contoured for a fit with a complementary surface of the dust guard fillet; and a dust guard lip which projects over the dust guard fillet and engages the dust guard, the dust guard lip having a length extending generally parallel with an axis of the annular structure;

wherein the dust guard lip is configured to provide a mechanical interference fit of the dust guard lip with the dust guard of 0.052-0.1875 inches with a maximum diameter of the dust guard for each Class of railcar axle; and wherein the annular structure further comprises a radially contoured edge portion extending from the dust quard lip with a radius of curvature toward an outer surface of the annular structure and terminating at an edge of the annular structure.

9. The one-piece, integrally formed universal backing ring of claim 8, further comprising:

a relief groove disposed between the inner contoured surface and the dust guard lip, the relief groove having a radius of curvature and having a radial depth extending radially from the dust guard lip.

10. The one-piece, integrally formed universal backing ring of claim 9, wherein the relief groove has a radial depth of 0.040-0.438 inches from the dust guard lip.

11. The one-piece, integrally formed universal backing ring of claim 9, wherein the relief groove has a radius of 0.030-0.438 inches.

12. The one-piece, integrally formed universal backing ring of claim 9, wherein the relief groove is concave.

13. The one-piece, integrally formed universal backing ring of claim 8, wherein the annular structure is made of material exhibiting a predetermined stiffness allowing portions of the annular structure at the relief groove, the radially contoured edge portion and the dust guard lip to deflect, facilitating the mechanical interference fit of the dust guard lip with the dust guard.

14. The one-piece, integrally formed universal backing ring of claim 8, wherein the radially contoured edge portion has a radius of 0.030-0.375 inches.

15. The one-piece, integrally formed universal backing ring of claim 8, wherein the radially contoured edge portion is convex.

16. The one-piece, integrally formed universal backing ring of claim 8, wherein the dust guard lip has a length of 0.000-0.375 inches.

17. The one-piece, integrally formed universal backing ring of claim 8, wherein the railcar axle is rated Axle Class E, Axle Class F, Axle Class K, or Axle Class G.

18. The one-piece, integrally formed universal backing ring of claim 17, wherein the maximum diameter of the dust guard on the railcar axle is:

7.032 inches for an Axle Class E, 7.532 inches for an Axle Class F, 7.532 inches for an Axle Class K, and 8.002 inches for an Axle Class G.

19. The one-piece, integrally formed universal backing ring of claim 8, wherein the integrally formed, one piece annular structure comprises ductile iron or steel.

* * * * *